US006105493A

United States Patent [19]

Skubic et al.

[11] Patent Number: 6,105,493

[45] Date of Patent: Aug. 22, 2000

[54] ELEVATOR CARD TRANSPORTING MECHANISM FOR A PRINTER

[75] Inventors: Robert L. Skubic, Chanhassen; Ronald L. Sattler, Bloomington; Timothy J. Flitsch, Savage, all of Minn.

[73] Assignee: Datacard Corporation, Minneapolis, Minn.

[21] Appl. No.: 08/997,427

[22] Filed: Dec. 23, 1997

[51] Int. Cl.[7] ..... B41F 17/14; B65H 5/02

[52] U.S. Cl. ..... 101/40; 101/40.1; 101/43; 101/44; 271/6; 400/525

[58] Field of Search ..... 101/40, 40.1, 37, 101/43, 44; 271/6, 184, 185, 186, 198; 400/525

[56] References Cited

U.S. PATENT DOCUMENTS

| | | | |
|---|---|---|---|
| 4,179,210 | 12/1979 | Bestenreiner et al. | 355/10 |
| 4,438,696 | 3/1984 | George et al. | 101/180 |
| 4,495,507 | 1/1985 | Moriguchi et al. | 347/173 |
| 4,594,597 | 6/1986 | Lin et al. | 400/224.2 |
| 4,694,305 | 9/1987 | Shiomi et al. | 400/206 |
| 4,707,706 | 11/1987 | Nagano | 400/120 |
| 4,746,111 | 5/1988 | Naramore | 271/287 |
| 4,857,941 | 8/1989 | Kaida | 400/240 |
| 4,863,297 | 9/1989 | Fujii | 400/249 |
| 5,090,554 | 2/1992 | De Sanctis | 271/184 |
| 5,094,336 | 3/1992 | Lundstrom et al. | 271/268 |
| 5,100,125 | 3/1992 | Uplinger et al. | 271/233 |
| 5,189,477 | 2/1993 | Leys et al. | 355/271 |
| 5,326,179 | 7/1994 | Fukai et al. | 400/525 |
| 5,440,328 | 8/1995 | Nardone et al. | 347/173 |
| 5,442,431 | 8/1995 | Fujimoto et al. | 271/202 |
| 5,528,277 | 6/1996 | Nardone et al. | 347/198 |
| 5,546,115 | 8/1996 | Nardone et al. | 347/214 |
| 5,546,116 | 8/1996 | Nardone et al. | 347/218 |
| 5,600,362 | 2/1997 | Morgavi et al. | 347/218 |
| 5,610,649 | 3/1997 | Kokubo | 347/175 |
| 5,729,820 | 3/1998 | Jamzadeh et al. | 399/407 |
| 5,920,055 | 7/1999 | Roth et al. | 235/380 |

FOREIGN PATENT DOCUMENTS

| | | |
|---|---|---|
| 0 419 108 | 3/1991 | European Pat. Off. . |
| 0 744 297 | 11/1996 | European Pat. Off. . |
| 195 43 099 A1 | 5/1997 | Germany . |
| 63-037049 | 2/1988 | Japan . |
| WO 92/17856 | 10/1992 | WIPO . |

OTHER PUBLICATIONS

Sep. 1996 "An Introduction to Digital Color Printing", AGFA Education Publishing, pp. 2–5.

*Primary Examiner*—John S. Hilten
*Assistant Examiner*—Daniel J. Colilla
*Attorney, Agent, or Firm*—Merchant & Gould P.C.

[57] ABSTRACT

The present invention provides a transport mechanism, and method, for transporting plastic cards, such as credit cards, identification cards, and the like, past a printing apparatus within a printer. The transport mechanism includes a lifting and rotating station for displacing the card from a first level to a second level, as well as rotating the card. The second level is located above the top of the printing apparatus. A card translating station is disposed at the second level, generally above the printing apparatus, and has a receiving end disposed adjacent the lifting and rotating station for receiving the card therefrom, as well as an output end. The translating station includes means for moving the card from the receiving end to the output end thereof along a direction that is generally perpendicular to the direction of movement of the lifting and rotating station. A card lowering station is disposed adjacent the output end of the translating station, on the other side of the printing apparatus, for receiving the card from the output end and displacing the card from the second level to a third level that is generally equal to the first level.

15 Claims, 4 Drawing Sheets

ELEVATOR CARD TRANSPORTING MECHANISM FOR A PRINTER

FIELD OF THE INVENTION

This invention relates to printers, and more particularly relates to a mechanism for transporting a plastic card past a printing apparatus within a printer.

BACKGROUND OF THE INVENTION

Printers are known that perform color printing on plastic cards, such as credit cards, identification cards, and the like. In certain printers, the printing is not performed directly onto the cards, but printing is instead performed on a receptor material which is then mated with the card to permit transfer of the printed image from the receptor material onto the card. In these situations, the cards must be transported past the printing apparatus of the printer, where the cards are then mated with the receptor material downstream of the printing apparatus. Since space is critical in these printers, the mechanism for transporting the cards past the printing apparatus must be constructed so that the size of the printer can be minimized.

What is needed then is a card transport mechanism for transporting cards past a printing apparatus within a printer, with the card transport mechanism being constructed so as to minimize the size of the printer.

SUMMARY OF THE INVENTION

The present invention provides an apparatus and method for transporting plastic cards, such as credit cards, identification cards, and the like, past a printing apparatus within a printer. In particular, the present invention provides a transport mechanism that is designed to transport the cards over the top of the printing apparatus, thereby allowing the size of the printer to be minimized to the sides of, or below, the printing apparatus. The present invention also finds particular use when the areas to the sides of, or below, the printing apparatus are crowded with ancillary apparatus, thus preventing card transport from taking place to the sides or below the printing apparatus.

A preferred embodiment of the transport mechanism in accordance with the principles of the present invention includes a first elevator mechanism for displacing the card from a first level to a second level, as well as rotating the card. The second level is located above the top of the printing apparatus. A translating mechanism is disposed at the second level, generally above the printing apparatus, and has a receiving end disposed adjacent the first elevator mechanism for receiving the card therefrom, as well as an output end. The translating mechanism includes means for moving the card from the receiving end to the output end thereof along a direction that is generally perpendicular to the direction of movement of the first elevator mechanism. A second elevator mechanism is disposed adjacent the output end of the translating mechanism, on the other side of the printing apparatus, for receiving the card from the output end and displacing the card from the second level to a third level that is generally equal to the first level.

Once a card is lowered to the third level by the second elevator mechanism, the card can then be transported to a mating and image section where the card is mated with a receptor material having a printed image, preferably a color image, thereon, and the image transferred onto the card in a conventional manner. After the image is transferred, the card is then transported to a card rotating station where the card is rotated back into its proper orientation if needed.

The invention further includes a method of transporting a card past a printing apparatus within a printer including providing a first elevator mechanism adjacent to one side of the printing apparatus, a translating mechanism having a receiving end receiving the card from the first elevator mechanism and having an output end spaced from the receiving end, and a second elevator mechanism adjacent to an opposite side of the printing apparatus receiving the card from the output end of the translating mechanism. The card is displaced from a first level to a second level spaced above the top of the printing apparatus using the first elevator mechanism. The card is then moved from one side of the printer apparatus to the opposite side thereof using the translating mechanism. Finally, the card is displaced from the second level to a third level using the second elevator mechanism. Therefore the card is disposed on the other side of the printing apparatus, where it can then be mated with a receptor material to transfer the image therefrom onto the card.

These and various other advantages and features of novelty which characterize the invention are pointed out with particularity in the claims annexed hereto and forming a part hereof. However, for a better understanding of the invention, its advantages and objects attained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
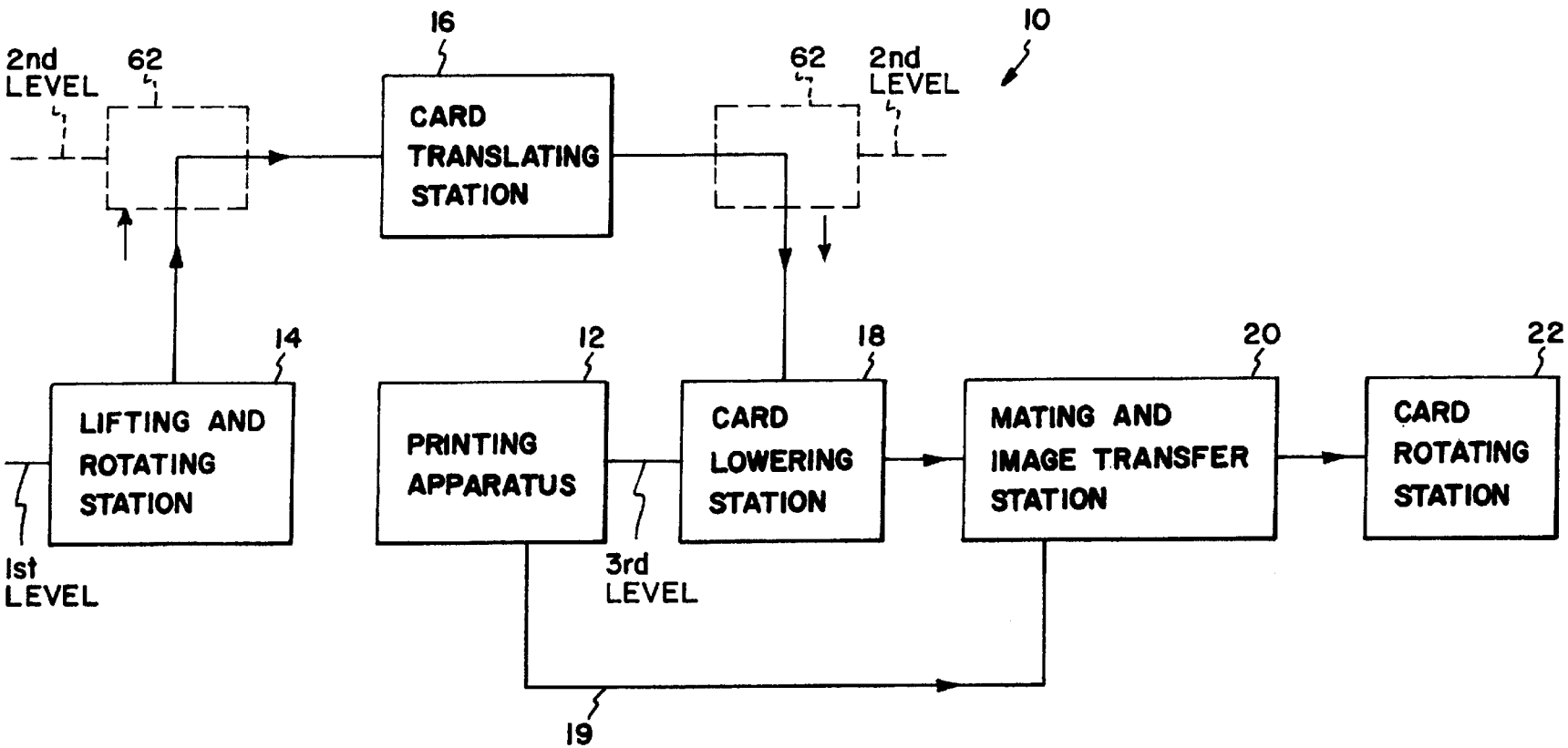
FIG. 1 is a diagrammatic view of the card transport mechanism which transports card over the top of a printing apparatus.

With reference initially to FIG. 1, the card transport mechanism 10 for transporting a card, which is substantially of a shape defined by a plane, past a printing apparatus 12 within a card printer is broadly illustrated. The transport mechanism 10 generally includes a lifting and rotating station 14 that lifts a card from a first level to a second level located above the top of the printing apparatus 12, (i.e. the station 14 is a first elevator mechanism) wherein the lifting and rotating station 14 maintains the plane of the card generally parallel to the direction of lift, as well as rotating the card 180 degrees. A card translating station 16 is disposed at the second level generally above the printing apparatus 12 for receiving the card from the lifting and rotating station 14 and moving the card from one side of the printing apparatus to the other side thereof. Once on the other side of the printing apparatus 12, the card is received by a card lowering station 18 which lowers the card from the second level to a third level (i.e. the station 18 is a second elevator mechanism), wherein the card lowering station 18 maintains the plane of the card generally parallel to the direction of lowering. The third level is preferably equal to the first level such that the card is lowered the same distance that it is raised, however the third level could be either higher or lower than the first level, such that the card is disposed at a different height than the first level.

As further illustrated in FIG. 1, after the card is lowered by the lowering station 18, the card is then transported to a mating and image transfer station 20 where the card is mated with a receptor material 19 having a desired image printed thereon by the printing apparatus 12, with the receptor material 19 being suitably directed to the mating and image transfer station after the image is printed thereon. The printing apparatus is preferably a color printer so that the image on the receptor material is a color image. Once the card is properly mated with the receptor material, the mating and image transfer station 20 causes the image to be transferred from the receptor material onto the card, thereby generating a printed card. The transfer of the image from the receptor material onto the plastic card is preferably accomplished using a pair of heated pressure rollers between which the mated receptor material and card pass to cause transfer of the image onto the card. The transferring of an image from a receptor material onto a plastic card is conventional in the art, and is therefore not described in detail herein. After the image is transferred onto the card, the card is separated from the receptor material and transported to a card rotating station 22 which rotates the card 180 degrees back to the orientation the card had prior to being rotated by the lifting and rotating station 14.

Figure 2:
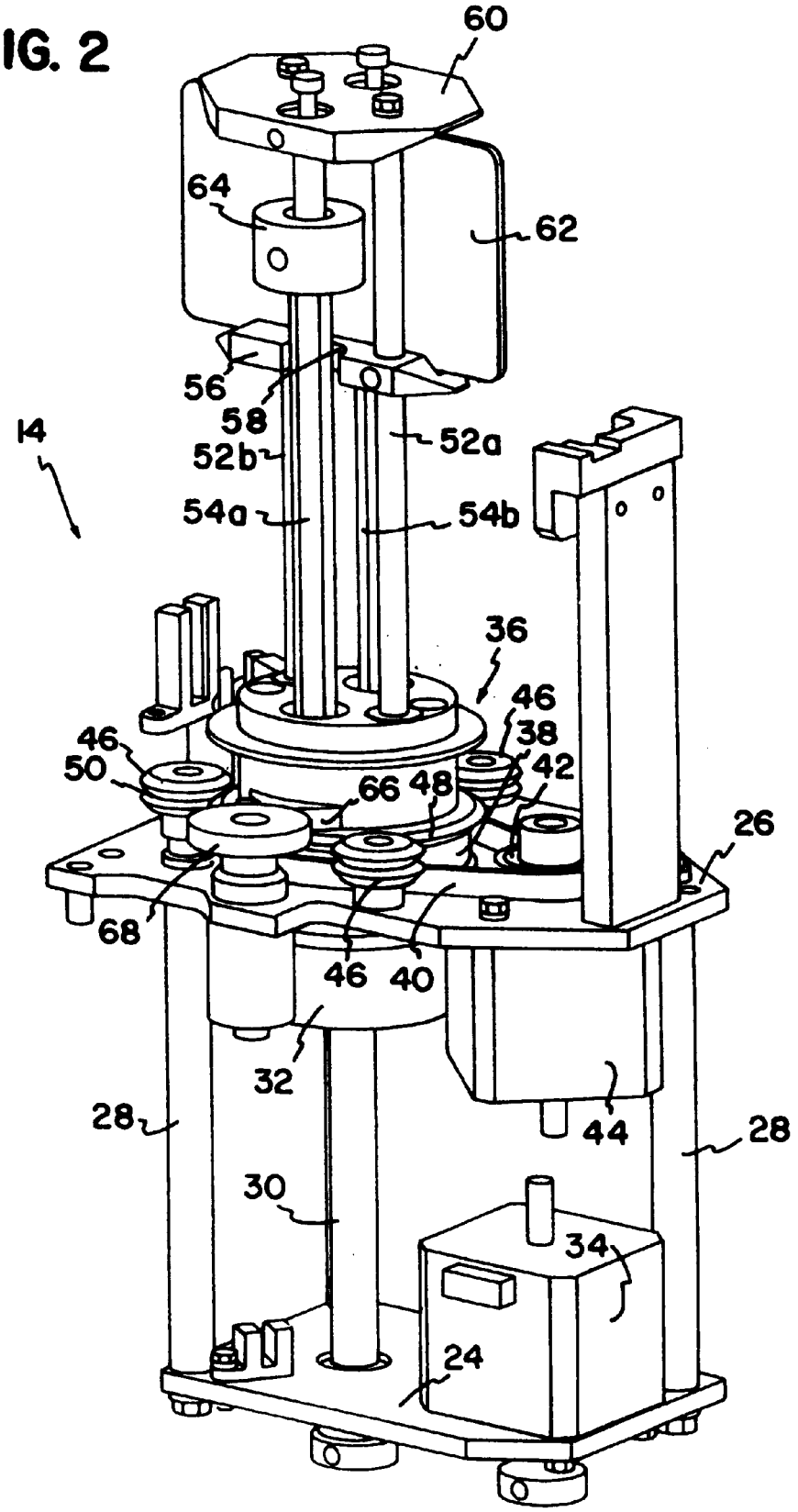
FIG. 2 is a detailed view of the first elevator mechanism which lifts and rotates the card.

With reference now to FIG. 2, the details of the lifting and rotating station 14 are illustrated. The station 14 includes a fixed base plate 24 and an upper, fixed plate 26 spaced from the base plate 24 by stand-offs 28. A threaded lead screw 30 is rotatably mounted in the base plate 24 and extends upward toward the plate 26. The lead screw 30 extends through the center of a cylindrical actuating block 32 and engages with an internally threaded nut secured within the block 32 as is conventional, whereby as the lead screw 30 is rotated, the actuating block 32 moves up and down thereon, depending upon the rotation direction of the lead screw. The lead screw 30 is preferably driven through a suitable connection to a drive motor 34 mounted on the base plate 24.

A hollow, rotatable guide skirt 36 is rotatably mounted on the plate 26. The guide skirt 36 includes a pulley section 38 adjacent the bottom thereof about which one end of a drive belt 40 extends to cause rotation of the guide skirt 36. The other end of the drive belt 40 extends around a drive pulley 42 which is driven in rotation by a drive motor 44. A plurality of guide bearings 46 are rotatably disposed on the plate 26 around the guide skirt 36, with a rim 48 on the guide skirt extending within grooves 50 defined by the guide bearings 46. The guide bearings 46 guide the skirt 36 in its rotation, due to the engagement of the rim 48 within the grooves 50.

Fixed to the top of the actuating block 32 and extending upward therefrom are a pair of smooth, cylindrical rods 52*a*, 52*b* and a pair of hexagonal-sided, rotatable rods 54*a*, 54*b*. The rods 52*a,b* and 54*a,b* extend through the guide skirt 36 and are slideable relative thereto, such that as the actuating block 32 is moved up and down on the lead screw 30, the rods move with the actuating block and slide up and down relative to the guide skirt. A lower guide 56 is fixed to each of the rods 52*a,b* for movement therewith, with the guide 56 including a recess 58 in each of its sides (only one being shown in FIG. 2) so that the guide extends around the rods 54*a,b* to permit the rods 54*a,b* to rotate freely. The ends of the rods 52*a,b* are fixed to an upper guide 60, with the upper ends of the rods 54*a,b* being rotatably supported by the upper guide 60 to permit rotation of the rods 54*a,b* relative to the upper guide. As shown in FIG. 2, the guides 56,60 are configured such that the lower and upper edges, respectively, of a plastic card 62 are disposed therein and guided thereby as the card 62 is moved into and from the station 14. A friction roller 64 is fixed on each rod 54*a,b* (only one roller being visible in FIG. 2) for rotation therewith. The rollers 64 are positioned on the rods 54*a,b* generally midway between the lower and upper guides 56,60, and are spring loaded together. The card 62 fits between the rollers 64, as shown in FIG. 2, such that the card 62 is gripped by the rollers 64 to securely hold the card while the card is being lifted and rotated, and to cause ingress and egress of the card from the station 14.

Rotation of the rods 54*a,b*, and thus of the rollers 64, to cause the card 62 to be moved into or from the station 14, is due to a gear 66 (only one gear being visible in FIG. 2) mounted on each of the rods 54*a,b* within the guide skirt 36 and which gears 66 rotate with the guide skirt. The gears 66 include holes therethrough by which the gears are mounted on the rods 54*a,b*, with the holes having a shape complementary to the hexagonal shape of the rods, such that the rods can slide up and down relative to the gears 66 while being rotated by the gears when the gears are rotated. The gears 66 are in driving engagement with each other, with a drive gear 68 being engaged with one of the gears 66 and being rotatably driven through a suitable connection to a drive motor so as to rotate the gears 66 and thus the rods 54*a,b* and rollers 64. The gears 66 are located on opposite sides of the guide skirt 36 such that when the guide skirt is rotated 180 degrees, the gear 66 that is not visible in FIG. 2 is rotated into engagement with the drive gear 68. Therefore, the rotation capability of the rods 54*a,b* is always maintained.

Operation of the lifting and rotating station 14 is as follows. As shown in FIG. 2, the station is in its lifted configuration, with the card being lifted to the second level. Initially, the actuating block 32 will be lowered generally to a position close to the plate 24, with the lower guide 56 being located adjacent the top of the guide skirt. In this position, a card is input to the station 14 by rotating the rollers 64 until the card is disposed between the lower and upper guides 56,60, as shown in FIG. 2. The motor 34 is then activated to rotate the lead screw 30, thus causing the actuating block 32 to move upward, raising the rods and the guides 56,60 connected thereto. Depending upon which side of the card is to be printed on, the motor 44 can be simultaneously activated to rotate the belt 40 and thus the guide skirt 36, thereby rotating the rods 52*a,b* and 54*a,b*, as well as the actuating block 32, to cause the card to be rotated 180 degrees. Preferably, the card is rotated at the same time that it is lifted upward, however each of these steps can be done separately if desired. Once the card is lifted to the second level illustrated in FIG. 2, the rods 54*a,b* are again rotated, to thereby rotate the rollers 64 and cause movement of the card to the card translating station 16. The station 14 is then ready to receive a new card.

Figure 3:
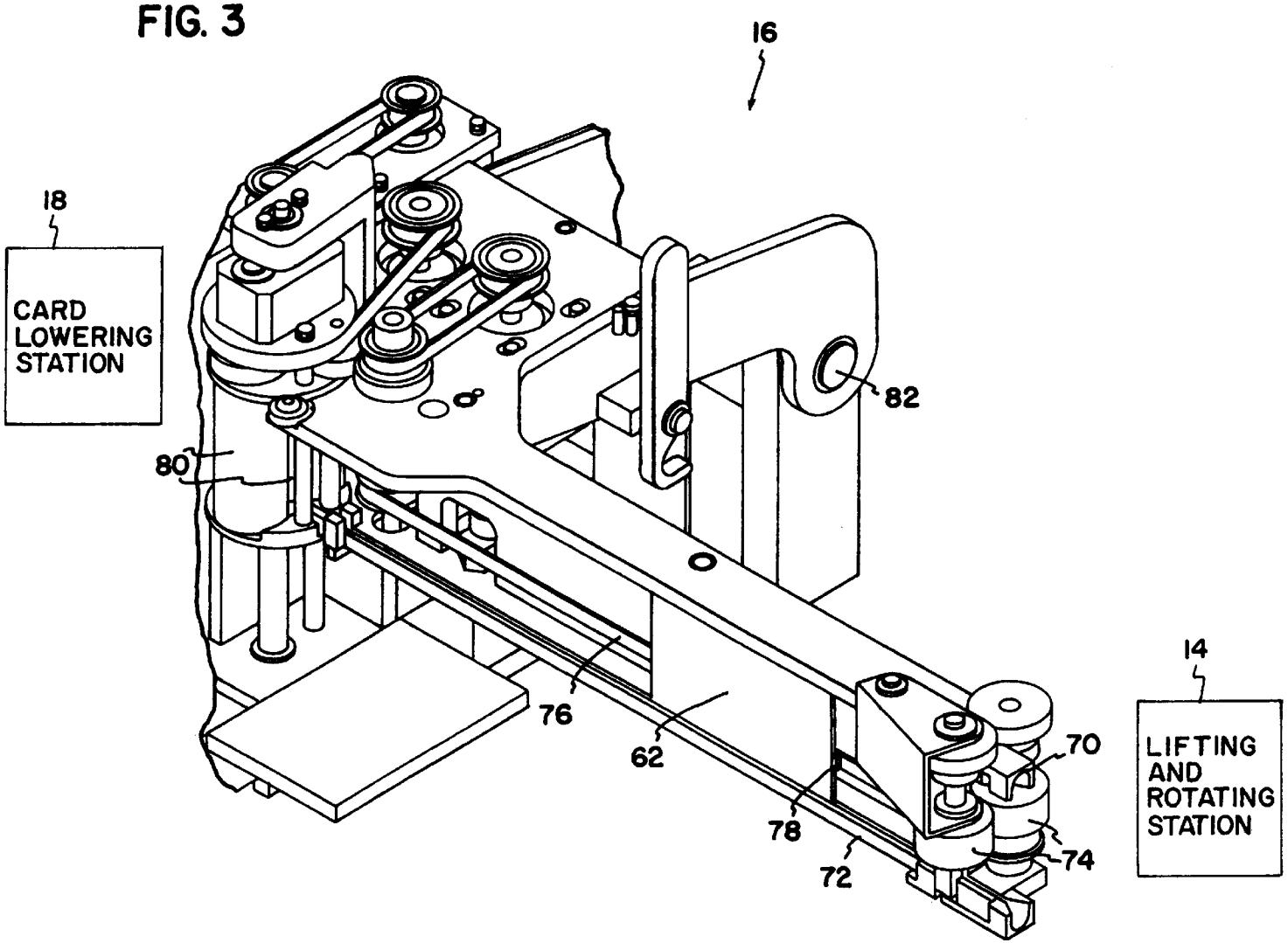
FIG. 3 is a detailed view of the card translating mechanism.

Turning now to FIG. 3, the card translating station 16 is illustrated therein. The station 16 is preferably constructed to transport the card 62 along a linear path over the printing apparatus 12. The station 16 includes upper and lower linear guide tracks 70,72 that are spaced apart a sufficient distance to receive the upper and lower edges, respectively, of the card to guide the card through the station 16. One end of the tracks 70,72 are disposed adjacent to the lifting and rotating station 14 and are arranged relative thereto to receive the card as it is discharged from the station 14. A pair of driven friction rollers 74, similar to the rollers 64, are mounted adjacent the end of the tracks 70,72 to drive the card into the tracks.

A drive belt 76 is mounted for rotation in a plane generally perpendicular to the card, and extends generally from the inlet end to the outlet end of the tracks 70,72. The drive belt 76 is driven in rotation by any suitable drive mechanism to cause movement of the card along the tracks from the inlet end to the outlet end thereof. The belt 76 preferably includes at least one projection 78 thereon which engages the rear edge of the card to cause movement of the card as the belt is rotated. A pair of friction rollers 80 are further disposed adjacent the outlet end of the tracks 70,72 to cause movement of the card to the card lowering station 18.

As shown in FIG. 3, the card translating station 16 is pivotally mounted within the printer by a pivot shaft 82, to permit the station 16 to be pivoted upward away from the printing apparatus 12 so that the printing apparatus can be more easily accessed.

Figure 4:
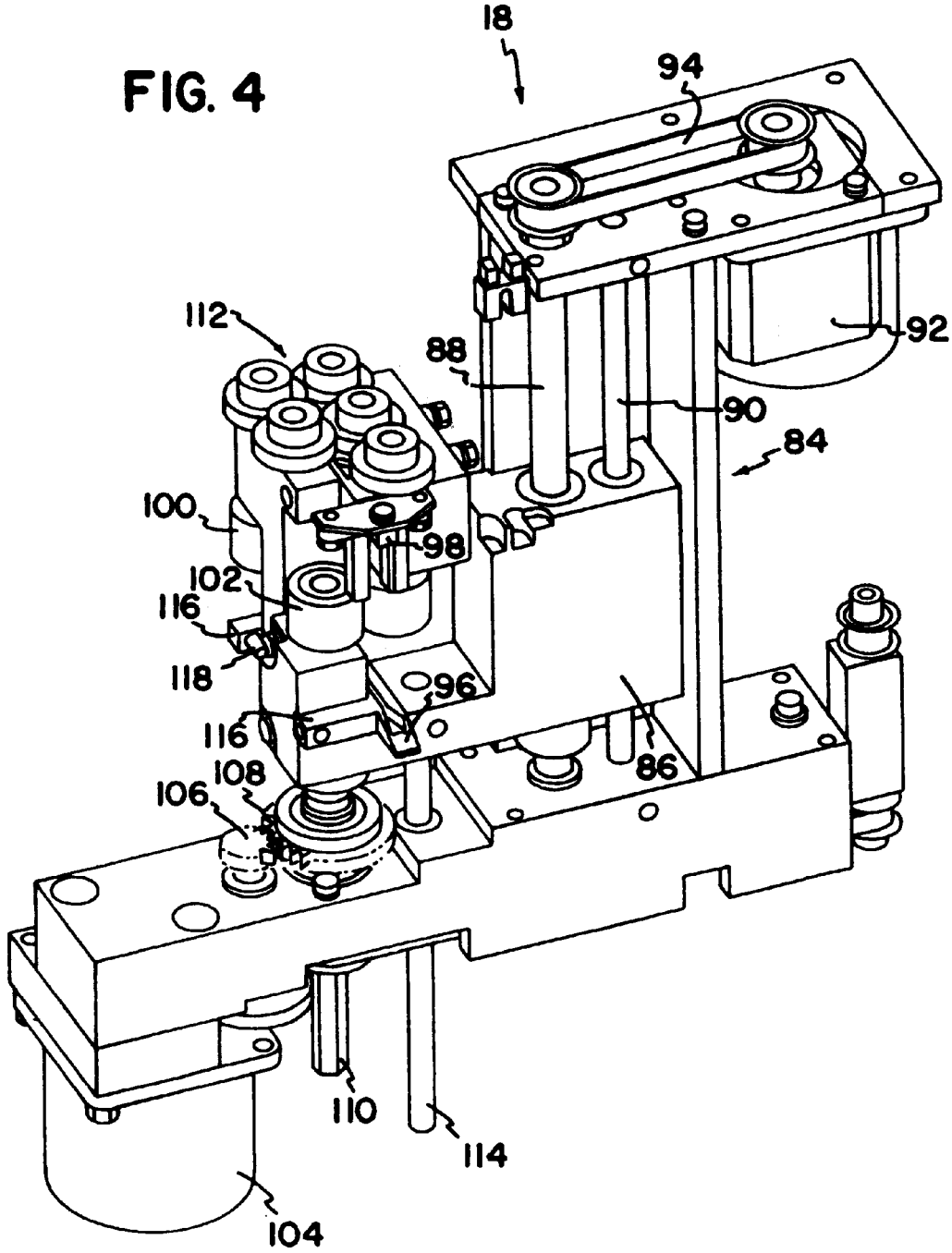
FIG. 4 is a detailed view of the second elevator mechanism which lowers the card.

The card lowering station 18, illustrated in FIG. 4, is suitably disposed adjacent to the output end of the station 16 to receive the card therefrom. The station 18 includes a stationary frame 84 mounted within the printer, with a block 86 mounted for up and down movement on the frame 84. A threaded lead screw 88 is rotatably mounted at each end thereof in the frame 84, with a stationary guide post 90 being fixed at each end to the frame 84 adjacent to the lead screw 88. The lead screw 88 extends through the block 86 and engages with an internally threaded nut secured to the block as is conventional, such that as the lead screw is rotated, the block 86 is caused to move up and down within the frame, depending upon the direction of rotation of the lead screw. Thus the operation of the block 86 and lead screw 88 is similar to the actuation block 32 and lead screw 30 of the station 14. A motor 92 is mounted on the frame 84, and is driveably connected to the lead screw by a drive belt 94, so as to selectively cause rotation of the lead screw. The guide post 90 extends through the block 86 such that the block slides on the guide post 90.

The block 86 includes a card receiving section including a lower guide 96 for receiving the lower edge of the card, and an upper guide 98 for receiving the upper edge of the card. The guides 96,98 hold the card during the lowering movement of the block, as well as guiding the card into and from the station 18. A first pair of friction rollers 100 is mounted at one end of the guides 96,98, and a second pair of friction rollers 102 is mounted at the other end of the guides. The friction rollers 100,102 drive the card into and from the station 18, as well as securely holding the card as it is being lowered. The rollers 100,102 are driven in rotation by a motor 104 mounted on the frame 84, with the motor driving a pinion gear 106 that in turn drives a gear 108. The gear 108 is mounted on a hexagonal shaft 110 that is connected to one of the drive rollers 102. The gear 108 includes a hole therein that has a shape that is complementary to the hexagonal shaft 110 such that rotation of the gear 108 causes the shaft 110 to rotate, however the shaft 110 can slide relative to the gear 108 to permit the raising and lowering of the block 86. A series of gears 112 are connected to the remaining rollers 100,102, with the gears 112 being driveably connected to the shaft 110, such that each of the rollers 100,102 rotate at the same speed, with the rollers in each pair rotating in opposite directions.

The block 86 further includes a guide rod 114 extending from the bottom thereof and is slideably disposed through the frame 84. The guide rod 114 moves with the block 86 during its vertical movements, ensuring that the block 86 moves vertically as well as preventing rotation of the block 86.

The lower guide 96 includes a pair of arms 116 extending on either side of the block 86, with the arms 116 being pivotally connected to the block by pivot pins 118, such that the lower guide can pivot. A spring (not shown) is disposed underneath the lower guide 96 within a suitably provided hole in the block 86 so to engage the bottom of the guide 96, in order to bias the lower guide upward toward the upper guide 98. The upward bias on the lower guide 96 ensures that the card is properly located within the block 86 as the card is received from the station 16.

Operation of the station 18 is as follows. As illustrated in FIG. 4, the block 86 is in its lowered position at the third level. To receive the card from the station 16, the block is raised upward to the second level by rotating the lead screw 88 in the direction to cause the block to move upward. The station 18 is suitably located adjacent the station 16 to receive the card as the output rollers 80 cause movement of the card from the exit end of the station 16. The motor 104 is driven to cause the rollers 100,102 to rotate, thereby moving the card into position between the guides 96,98. Once the card is positioned, the motor 92 is rotated to cause the block 86 to move downward, thereby lowering the card to the third level. The motor 104 is then again actuated to cause the rollers 100,102 to rotate and cause movement of the card toward the mating and image transfer station 20. As stated previously, the card is preferably lowered by the station 18 to a level that is approximately equal to the first level at which the card is received by the station 14. However, the card can be lowered to a level that is either above or below the first level if desired.

As described previously, the mating and image transfer station 20 is a conventional structure which mates the card 62 with a receptor material. The receptor material is initially run through the printing apparatus 12 whereby a desired image is printed onto a portion of the receptor material. The card is then suitably mated with the printed image of the receptor material at the mating and image transfer station 20. After mating the card with the printed image, the station 20 causes the image to be transferred from the receptor material onto the card by laminating a portion of the receptor material onto the card, thereby generating a printed card. The transfer of the image from the receptor material onto the plastic card can be accomplished in many ways. For instance, the transfer can be accomplished using a pair of heated pressure rollers between which the mated receptor material and card pass to cause a layer of the receptor material having the printed image thereon to be laminated onto the card, thereby transferring the image onto the card. Receptor materials and the transfer of a printed image from the receptor material onto a card is known in the art, and needs not be further described herein.

In certain situations, it may be desirable not to transfer an image onto a card, and therefore a bypass can be provided to prevent mating of the receptor material and the card. Since the receptor material and the card are not mated, the printed image cannot be transferred.

After transfer of the printed image to the card, the card is then transported to the card rotating station 22. The station 22 is constructed so as to be able to rotate the card 180 degrees back to the orientation the card had prior to being rotated by the lifting and rotating station 14. Rotation of the card to the correct orientation can be accomplished using any suitable mechanism.

The card transport mechanism 10 is thus able to transport a card over and past a printing apparatus 12, utilizing space above the printing apparatus that might otherwise not be utilized, without interfering with the operation of the printing apparatus. While specific embodiments of the lifting and rotating station 14, the card translating station 16, and the card lowering station 18 have been illustrated herein, it should be realized that the stations 14, 16, 18 can have other constructions, as long as each station is able to perform its specific transport function(s).

It is to be understood that while certain embodiments of the present invention have been illustrated and described, the invention is not limited to the specific forms or arrangements of the parts described and shown. Instead, the invention resides in the claims hereinafter appended.

We claim:

1. A card transport mechanism for transporting a card past a printing apparatus within a printer, comprising:

a first elevator mechanism for displacing the card from a first level to a second level, the first elevator mechanism configured to hold the card such that the card is oriented in a plane while being displaced from said first level to said second level with the plane of the card parallel to a direction of displacement from said first level to said second level;

a translating mechanism disposed at the second level and having a receiving end disposed adjacent the first elevator mechanism for receiving the card therefrom and an output end, said translating mechanism including means for moving the card from the receiving end to the output end thereof along a direction that is generally perpendicular to the direction of movement of the first elevator mechanism; and a second elevator mechanism disposed adjacent the output end of the translating mechanism for receiving the card from the output end and displacing the card from the second level to a third level, the second elevator mechanism configured to hold the card such that the plane of the card is parallel to a direction of displacement from said second level to said third level.

2. The card transport mechanism according to claim 1, wherein the first level and the third level are disposed on the same side of the second level.

3. A card transport mechanism for transporting a card past a printing apparatus within a printer, comprising:

a first elevator mechanism for displacing the card from a first level to a second level, said first elevator mechanism includes means for rotating the card;

a translating mechanism disposed at the second level and having a receiving end disposed adjacent the first elevator mechanism for receiving the card therefrom and an output end, said translating mechanism including means for moving the card from the receiving end to the output end thereof along a direction that is generally perpendicular to the direction of movement of the first elevator mechanism; and a second elevator mechanism disposed adjacent the output end of the translating mechanism for receiving the card from the output end and displacing the card from the second level to a third level.

4. A card transport mechanism for transporting a card past a printing apparatus within a printer, comprising:

a first elevator mechanism for displacing the card from a first level to a second level;

a translating mechanism disposed at the second level and having a receiving end disposed adjacent the first elevator mechanism for receiving the card therefrom and an output end, said translating mechanism including means for moving the card from the receiving end to the output end thereof along a direction that is generally perpendicular to the direction of movement of the first elevator mechanism, wherein the means for moving includes a rotatable belt extending between the receiving end and the output end, said rotatable belt being engageable with the card to thereby move the card from the receiving end to the output end; and a second elevator mechanism disposed adjacent the output end of the translating mechanism for receiving the card from the output end and displacing the card from the second level to a third level.

5. The card transport mechanism according to claim 4, wherein the rotatable belt includes a projection extending therefrom, said projection being engageable with the card.

6. The card transport mechanism according to claim 4, wherein the translating mechanism further includes a pair of spaced guide tracks, said guide tracks receiving opposite edges of the card to thereby guide the card as the card moves from the receiving end to the output end.

7. A card transport mechanism for transporting a card past a printing apparatus within a printer, comprising:

a first elevator mechanism for displacing the card from a first level to a second level;

a translating mechanism disposed at the second level and having a receiving end disposed adjacent the first elevator mechanism for receiving the card therefrom and an output end, said translating mechanism including means for moving the card from the receiving end to the output end thereof along a direction that is generally perpendicular to the direction of movement of the first elevator mechanism, wherein the translating mechanism is pivotally mounted; and a second elevator mechanism disposed adjacent the output end of the translating mechanism for receiving the card from the output end and displacing the card from the second level to a third level.

8. A printer comprising:

a printing apparatus; and a transport mechanism for transporting a card past the printing apparatus, the transport mechanism including a first elevator mechanism disposed adjacent one side of the printing apparatus for displacing the card from a first level to a second level, said second level being spaced above the top of the printing apparatus; a translating mechanism disposed at the second level and having a receiving end disposed adjacent the first elevator mechanism for receiving the card therefrom and an output end at an opposite side of the printing apparatus, said translating mechanism further including means for moving the card from the receiving end to the output end thereof along a direction that is generally perpendicular to the direction of movement of the first elevator mechanism; and a second elevator mechanism disposed adjacent the opposite side of the printing apparatus at the output end of the translating mechanism for receiving the card from the output end and displacing the card from the second level to a third level.

9. The printer according to claim 8, wherein the translating mechanism is pivotally mounted within the printer whereby the translating mechanism is pivotable toward and away from the printing apparatus.

10. The printer according to claim 8, wherein the first level and the third level are disposed on the same side of the second level.

11. The printer according to claim 8, wherein said first elevator mechanism includes means for rotating the card.

12. The printer according to claim 8, wherein the means for moving includes a rotatable belt extending between the receiving end and the output end, said rotatable belt includes a projection extending therefrom that is engageable with the card.

13. The printer according to claim 12, wherein the translating mechanism further includes a pair of spaced guide tracks, said spaced guide tracks receiving opposite edges of the card to thereby guide the card as the card is moved by the rotatable belt from the receiving end to the output end.

14. A method of transporting a card past a printing apparatus within a printer, comprising:

providing a first elevator mechanism adjacent to one side of the printing apparatus, a translating mechanism having a receiving end receiving the card from the first elevator mechanism and having an output end spaced from the receiving end, and a second elevator mechanism adjacent to an opposite side of the printing apparatus receiving the card from the output end of the translating mechanism;

displacing the card from a first level to a second level spaced above the top of the printing apparatus using the first elevator mechanism;

moving the card from one side of the printer apparatus to the opposite side thereof using the translating mechanism; and displacing the card from the second level to a third level using the second elevator mechanism.

15. The method of transporting according to claim 14, further comprising rotating the card using the first elevator mechanism.

* * * * *